United States Patent [19]

Thobroe

[11] 4,095,373

[45] Jun. 20, 1978

[54] MACHINE FOR PRODUCING SPHERICAL OBJECTS

[75] Inventor: Eivind Christian Thobroe, Stroud, England

[73] Assignee: National Research Development Corporation, London, England

[21] Appl. No.: 653,543

[22] Filed: Jan. 29, 1976

[51] Int. Cl.[2] ..... B24B 11/06

[52] U.S. Cl. ..... 51/130

[58] Field of Search ..... 51/130, 289 S, 161; 241/146; 37/79

[56] References Cited

U.S. PATENT DOCUMENTS

| | | | |
|---|---|---|---|
| 868,926 | 10/1907 | Hoffmann | 51/130 |
| 1,334,773 | 3/1920 | McIntyre | 51/130 X |
| 1,574,668 | 2/1926 | Mahe | 51/130 |
| 1,624,642 | 4/1927 | Vuilleumier | 51/130 |
| 1,921,686 | 8/1933 | Matteson | 51/130 |
| 2,309,078 | 1/1943 | Hollstein et al. | 241/146 |

FOREIGN PATENT DOCUMENTS

| | | | |
|---|---|---|---|
| 211,941 | 7/1909 | Germany | 51/130 |

*Primary Examiner*—James L. Jones, Jr.
*Assistant Examiner*—K. J. Ramsey
*Attorney, Agent, or Firm*—Cushman, Darby & Cushman

[57] ABSTRACT

A vertical plate machine for machining spherical objects, wherein the objects are worked between opposed generally vertical faces of opposed working plates which are relatively rotated, has a wheel carrying two plates in opposition to plates carried by non-rotary carriers on either side of the wheel. A force-applying connection extends centrally through the wheel and acts to draw the non-rotary carriers together. The wheel is vertically supported by centreless bearings at its periphery. The force-applying connection is disconnectible to permit movement of the non-rotary plate carriers away from the wheel for access to the plates. A compact, high output machine not requiring a massive frame and allowing good access to the plates is thus provided.

24 Claims, 6 Drawing Figures

MACHINE FOR PRODUCING SPHERICAL OBJECTS

BACKGROUND OF THE INVENTION

1. Field of the Invention

This invention relates to machines for machining spherical objects, e.g. metal or plastics material balls for anti-friction bearings or other uses. Particularly, the invention is concerned with vertical plate machines, in which the objects are machined between opposed generally vertical faces of opposed relatively rotatable working plates.

2. Description of the Prior Art

Bearing balls of highly exact sphericity are made in a number of stages. Firstly the blanks are headed or rolled to a rough spherical shape which leaves certain portions projecting from the material. The balls are then machined to the desired spherical shape in several stages on special machines, usually with heat treatment in a furnace after the first or second stage as far as metal balls are concerned. The first stage may be "flashing" in which metal balls are ground between two very hard "Meehanite" plates, the second may be grinding in which one grinding plate and one "Meehanite" plate are used and the third stage may be progressive lapping operations in which the balls are polished between two special metal plates and in which grit and coolant are used in most cases.

With the progress made during the last ten years in the techniques of rolling the roughly shaped steel balls at very high production rates compared to the conventional heading techniques, it has become very important also to improve the production rates of those machines engaged on processing the steel balls subsequent to rolling.

Previously conventional vertical plate machines used for these machining operations have had two members (in the form of castings) carrying opposed machining plates one or both of which have a number of grooves in them and one of which is rotated while the other is stationary, pressure being exerted on the stationary member to urge it towards the rotating one. The stationary member and its plate have a gap through which the balls are fed to and from the plate grooves. The balls are ground as they are driven around between the plates, which they hold apart. The very high pressure used, e.g. up to about 80,000 lbs. (36,000 Kg) for the flashing operation, necessitates very high rigidity in the frame which supports both members and receives the reaction forces from the stationary member and from the thrust bearing for the rotating member. Large and expensive cast iron frames are used, and these frames leave little room for the apparatus for delivering the balls to and receiving them from the grooves in the plates. In spite of the size of frame employed, there is a strong tendency for the frame to distort which leads to uneven wear of the grooves of the stationary plate. FIG. 1 of the drawings is a simplified view of a conventional machine of this kind and will be more fully described below.

A known development of the machine illustrated in FIG. 1 which greatly increases its output but with a similar increase in size and cost, is to provide a second pair of plate-carrying members axially spaced from the first pair, the central two members of the four plate-carrying members thus provided being supported in common by a single central pillar of the frame of the machine and the outer two members each being supported by a further pillar. The forces applied to the central pillar from the central two members at least to some extent counter-balance each other. The machine is very large and cumbersome.

An especial disadvantage of these known vertical plate machines is the difficulty of access to the plates for inspection for wear and for replacement. The presence of the large pillars close behind the plate-carrying members prevents movement of the members a sufficient distance apart for easy access to the plates. A periscope arrangement has been needed to inspect the faces of the plates, and changing plates is a troublesome operation.

Apart from vertical plate machines, there are also machines of a different type in which the working faces of the working plates are horizontal. These machines are generally smaller than vertical plate machines. They are not capable of producing steel balls of highly accurate sphericity at high outputs particularly because of the problems encountered in feeding the balls to and from the grooves in the plates. Because the plates are horizontal, the balls collect in large numbers in the feeding gap in the stationary plate, so that collisions of considerable force occur between balls when a ball is ejected at speed from between the plates. Collisions between balls reduce the accuracy of their macrofinish.

Another disadvantage of horizontal plate machines is also poor access to the plate surfaces, since the plates and their associated carriers, which are heavy, must be lifted in order to gain such access.

In one known horizontal plate machine, made by Sebastian Messerschmidt Spezialmaschinenfabrik, the stationary plate carrier is mounted above the rotary plate carrier and the reaction load from the plates is transmitted by a tensioned rod passing centrally through the plates. The load is applied by the rod to the frame of the machine, in which the rotary plate carrier is mounted in ball bearings the races of which are coaxial with the axis of rotation. The rotary plate carrier is driven through a gear engaging toothing on an axial end face of an annular sleeve secured to the back of the rotary plate carrier. This machine suffers from the disadvantages of its type described above.

SUMMARY OF THE INVENTION

It is an object of the invention to provide a vertical plate machine having a high output at high accuracies and yet not requiring a massive frame structure to accommodate the pressures applied to the objects being machined.

It is another object to provide a vertical plate machine having two sets of working plates and therefore a double output, while having a relatively simple and light construction.

It is yet another object of the invention to provide a vertical plate machine having much improved access to the working plates, more particularly a machine in which the working plates are removable without obstructing each other.

In accordance with the present invention, in a vertical plate machine, a pressure-applying connection extends from the non-rotary plate carrier to the rotary plate carrier and includes force-generating means which acts through the connection to urge the plate carriers relatively towards one another thus applying pressure at the working faces. The connection has at least a portion extending centrally through the working plates, this portion being placed under tension by the force generating means. The connection including the force generating means is preferably so arranged that with the plate carriers it forms an assembly within which the pressure applied by the plates to objects being machined and the reaction forces therefrom are substantially confined and equalised. In theory this assembly only requires vertical support, but in practice some axial support may be provided. Nevertheless a massive rigid frame required to accommodate the full load applied at the plate faces can be avoided.

To provide a machine of double output in accordance with the invention, two non-rotary plate carriers are provided which carry working plates in opposition to plates carried by respective opposite faces of the rotary plate carrier which is mounted between the non-rotary plate carriers and is in the form of a wheel supported at its periphery by bearing means. The bearing means may be centreless and is preferably a plurality of rolling members engaging the periphery of the wheel and rotatable about stationary axes spaced from the axis of the wheel. In this way a compact arrangement is provided.

Preferably the force-applying means is arranged centrally with respect to the wheel and extends axially through the centre of the wheel, being connected to the non-rotary plate carriers on either side of the wheel. In this way the forces applied to the wheel can be balanced in a simple manner. The non-rotary plate carriers may be supported substantially wholly by the wheel through the objects being machined during operation of the machine, so that horizontal forces are balanced and the frame of the machine accommodates substantially only vertical loading.

In order to provide good access to the working plates, it is proposed that pressure-applying means for urging the rotary and non-rotary plate carriers towards each other are disconnectible so as to permit movement of the non-rotary plate carrier away from the rotary plate carrier. Support means for the non-rotary plate carrier are provided which are arranged to support it at least when the pressure applying means is disconnected and during said movement of the non-rotary plate carrier so that the non-rotary plate carrier is supported during access to the plates for their inspection or replacement. Hitherto, support means for the plate carriers when disconnected from the pressure-applying means have not been provided, so that the plate carriers have not been capable of movement sufficiently far apart to allow easy access.

Suitably the support means permits pivotting of the non-rotary plate carrier about a vertical axis. The plate carried by it may thus be turned so as to be removable without obstruction by the rotary plate, e.g. it may be removed in a straight line perpendicular to its face without obstruction by the rotary plate.

BRIEF DESCRIPTION OF THE DRAWINGS

The known machine referred to above, and two machines embodying the invention, will now be described by way of non-limitative example with reference to the accompanying drawings, wherein.

DESCRIPTION OF THE PRIOR ART MACHINE

Figure 1:
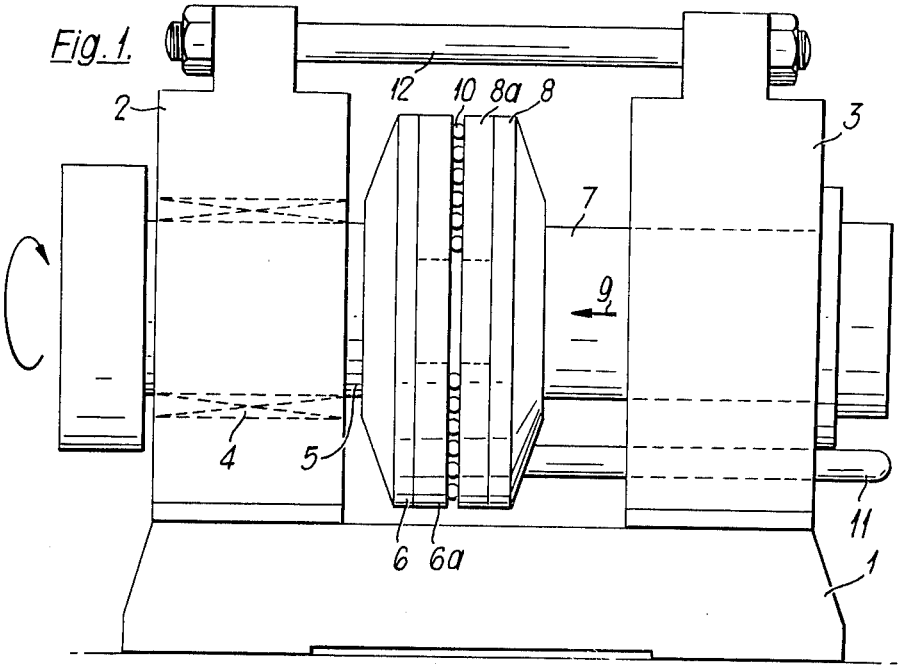
FIG. 1 is a schematic side view of the conventional prior art vertical plate machine.
Figure 2:
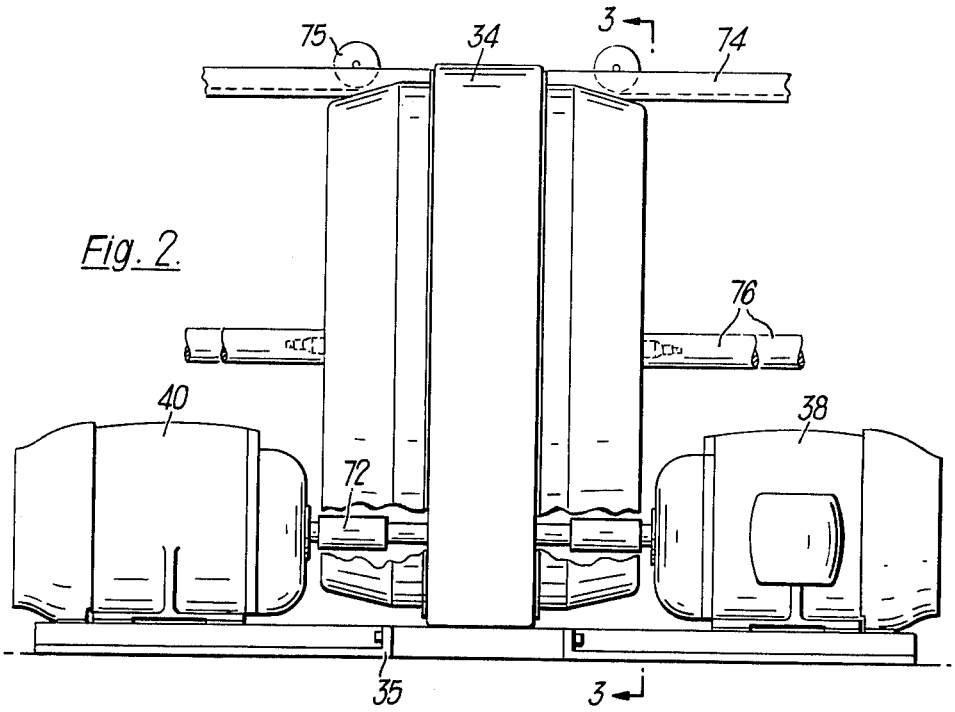
FIG. 2 is a side view of a vertical plate machine embodying the present invention and having two non-rotating plates.
Figure 3:
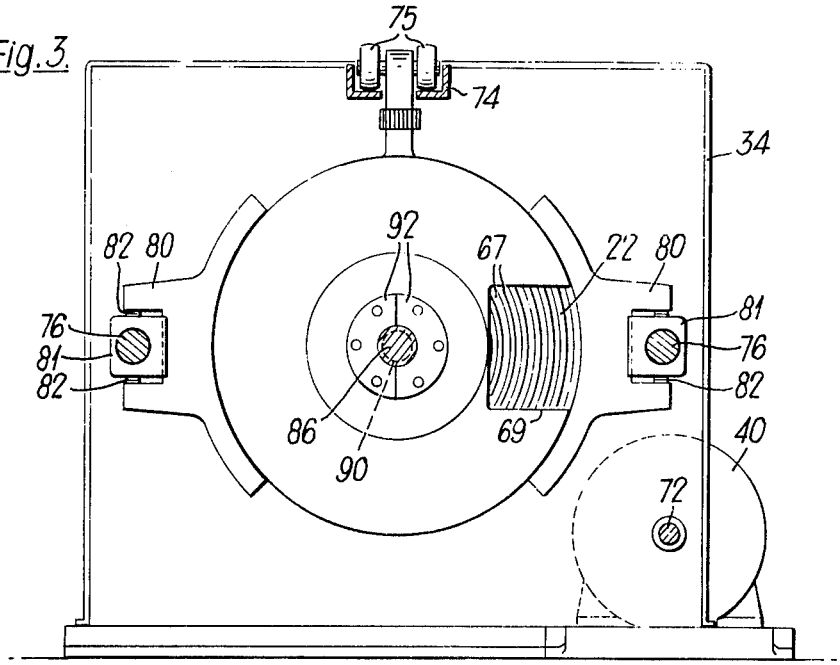
FIG. 3 is a sectional view on the line 3—3 of FIG. 2 with part of the casing and other parts being omitted for clarity.
Figure 4:
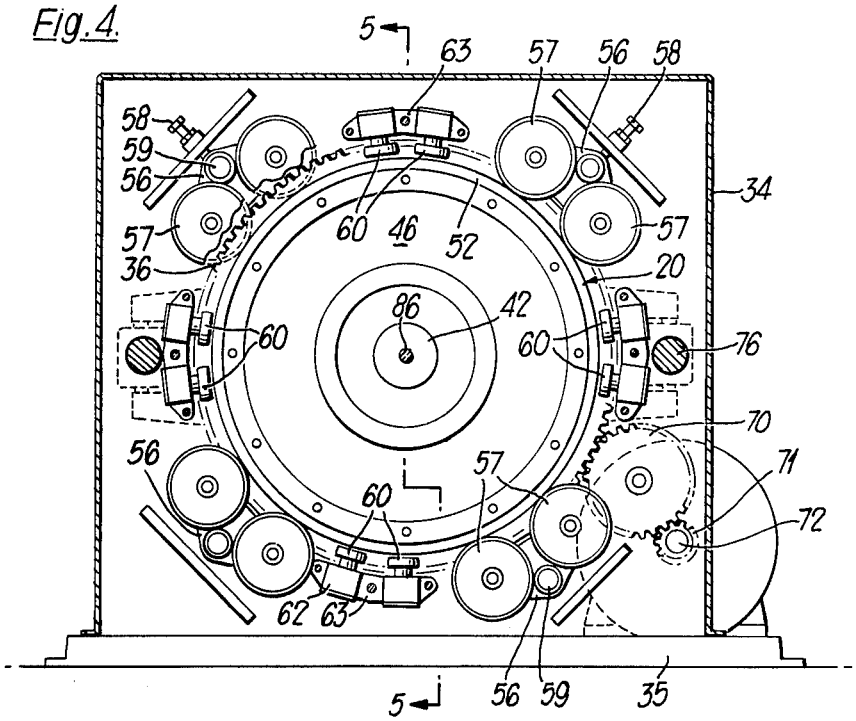
FIG. 4 is a sectional view on the lines 4—4 of FIG. 5.
Figure 5:
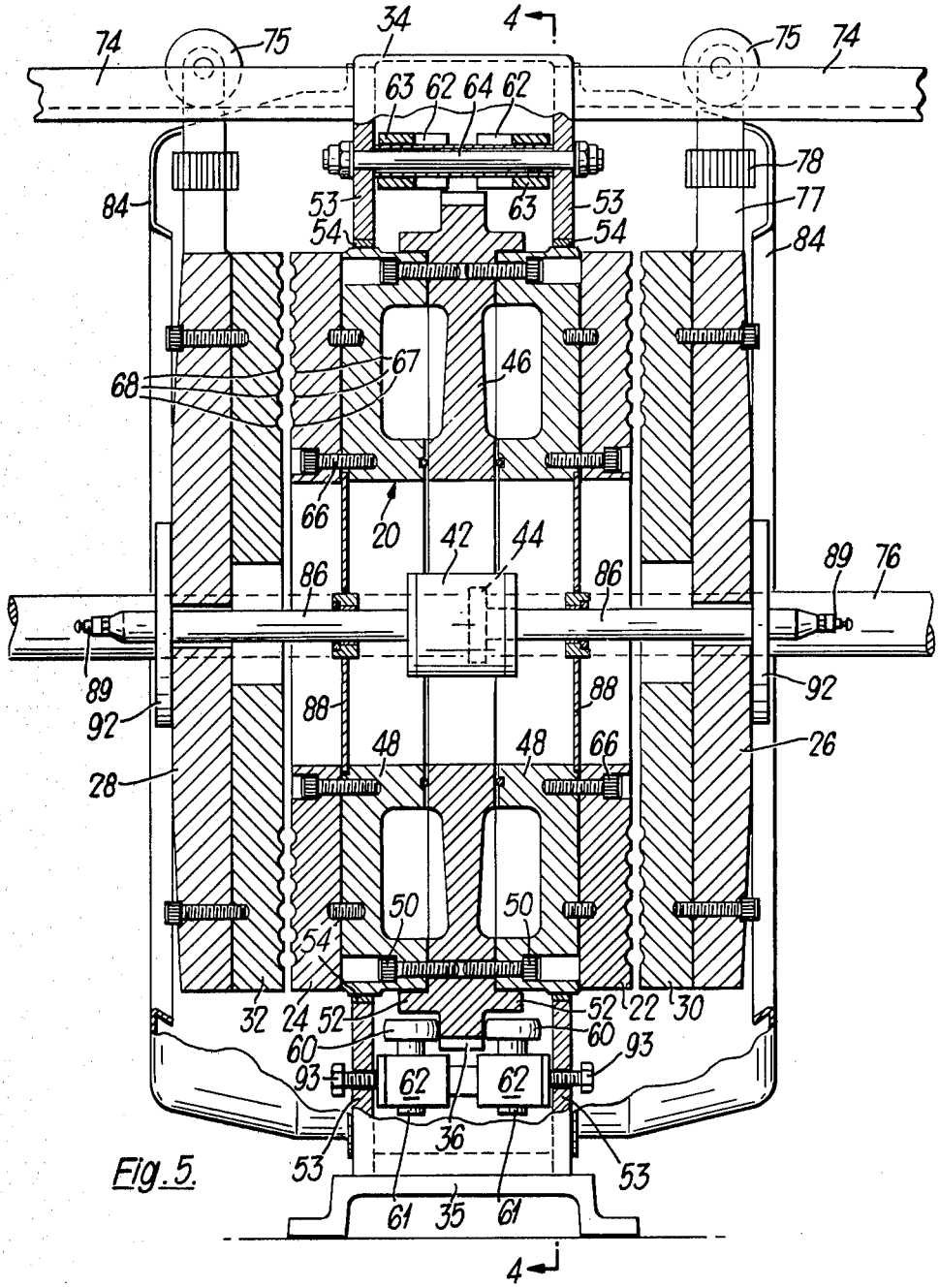
FIG. 5 is a sectional view, mainly axial, on the line 5—5 of FIG. 4.

The known machine of FIG. 1 has a frame consisting of a base or bed-plate 1 and two cast pillars 2 and 3. The left hand pillar 2 supports in a suitable thrust bearing 4 a rotatable shaft 5 which is rotated by a motor through belts (not shown) engaging pulleys on its outer end. At its other end the shaft 5 carries a rotary plate carrier 6 which itself carries a rotary machining plate **6*a* (or ring plate). The right hand pillar 3 carries a non-rotatable shaft 7 on which is mounted a stationary plate carrier 8 carrying a non-rotary machining plate 8*a* (or gap plate), which is opposed to the rotary plate 6*a*. Means (not shown) e.g. various mechanical and hydraulic means, are provided for moving and urging the plate carrier 8 in the direction of the arrow 9 towards the opposed plate 6*a***.

The stationary plate **8*a* is similar to the plate 30 shown in FIGS. 2 to 5, having a cut-out sector and a number of coaxial part-circular grooves each of which begins and ends at the cut out sector. The rotary plate 6*a* has a corresponding set of complete circular grooves. In operation partially formed ball bearings 10 are fed into the cut-out sector of the stationary plate 8*a* while the rotary plate 6*a* is rotated and the stationary plate 8*a* is urged towards the plate 6*a*. The grooves in the stationary plate have a short lead-in of wider cross-section so that the balls enter the grooves and are carried round for one part circle until they are ejected back into the cut-out sector whereupon they are removed or recirculated. During passage along the grooves the balls are being continually reoriented with respect to the machining plates and are ground towards a more and more spherical shape. A rod 11 projecting from the plate carrier 8** prevents rotation of that carrier with the rotating carrier. The process described is similar for flashing, grinding and lapping except that different plates, sometimes one of them being grooveless, are used for the different stages. The plate pressures are also adjusted depending on the type of ball processing desired.

As discussed above, a problem arising in this conventional machine is that the very large forces between the plates tend to cause distortion of the frame by pushing the pillars 2,3 apart. The frame must therefore be very rigid and is usually of cast iron and very heavy. The rotating plate must therefore be carried at the end of a shaft rotating in bearings suitably designed to withstand the maximum journal and thrust loads at all times while the stationary plate must be carried at the end of a piston/ram assembly accurately guided in a cylindrical housing of considerable size. A tie bar 12 joining the tops of the pillars 2,3 is often provided but this does not eliminate the problem of distortion of the frame resulting in non-uniform pressures between the plates and unequal wear of the grooves of the machining plates. Additionally, the plate carriers 6,8 can be moved apart only by a limited distance so that access to the plates for inspection or removal is poor.

DESCRIPTION OF THE PREFERRED EMBODIMENTS

The machine embodying the present invention shown in FIGS. 2 to 5 consists, in brief, of a centrally positioned rotary plate carrier in the form of a wheel 20 which can carry two vertical machining plates 22, 24 one on each side opposed respectively to vertical machining plates 30, 32 carried by non-rotary plate carriers 26,28. The wheel 20 is mounted in a housing 34 on a rigid base formed by a bed-plate 35 and has toothing 36 at its periphery whereby it is driven in rotation by two electric motors 38,40. A single electric motor might alternatively be employed. To apply pressure between the opposed faces of the grinding plates, the non-rotary carriers 26,28 are connected together by a force-applying connection which passes through a central bore in the wheel 20 in this case being at the axis of rotation of the wheel. The connection includes in this case a hydraulic cylinder 42 and piston 44 whereby the non-rotary carriers 26,28 can be drawn towards each other. The force-applying connection can take any suitable form provided it contains means whereby the required plate pressures can be generated.

In more detail, the wheel 20 consists of a central annular member 46 having the toothing 36 at its periphery and two annular side members 48 secured thereto by screws 50 and radially located by axial flanges 52 at the periphery of the wheel. One side member 48 is absent in the view of FIG. 4. The radially outward periphery of the wheel 20 is of larger diameter than the plates carried by the wheel. The housing 34 has vertical plates 53 having circular openings which are closed to the side members 48 by seals 54 shown in FIG. 5. The housing 34 with seals 54 comprises means for preventing access of ground-off particles to the structures located therewithin.

The weight of the wheel 20 (and of the non-rotary plate carriers 26, 28 when the wheel 20 is supporting them as described below) is entirely taken by the bottom pair of four bogies 56 which each have four wheels 57 rotatable about stationary axes and engaging the radially outer faces of the flanges 52. The bogies 56 are pivotally mounted on axles 59 which are parallel to the axes of the wheels 57 and are fixed within the housing and are radially adjustable to take up slack by screws 58. The two bottom bogies 56 primarily support the wheel 20 in the radial i.e. vertical direction and comprise bearing means. The two top bogies 56 provide additional support during rotation and prevent the wheel from being lifted up for some reason, e.g. by reaction forces between the balls and plate grooves.

Lateral forces on the wheel 20 are controlled by guide means in the form of rollers 60 which rotate about axes radial with respect to the wheel 20 and engage the smooth axial faces of the member 46 adjacent the toothing 36. The rollers 60 are mounted on axles 61 journalled in axle boxes 62 which are portions of castings 63. Pairs of the castings 63, each having two axle boxes 62, are pivotally mounted on shafts 64 fixed in the side plates 53, one casting 63 of each pair being to each side of the wheel 20. The pairs of casting 63 can be axially adjusted to eliminate any clearance of the rollers 60 from the wheel 20 by means of bolts 93 threaded in the side plates 53 and abutting against the castings 63.

On their axially outer faces the side members 48 carry the rotating machining plates 22, 24 (ring plates) which are secured by recessed screws 66 or alternative means. The plates 22, 24 have a plurality of circular grooves 67 in their axially outer faces which in this particular case correspond to and are opposed to part-circular grooves 68 in the non-rotating machining plates 30,32 (gap plates). The grooves 68 start and end at a cut-out sector or gap 69 (see FIG. 3) in the non-rotating plate. The non-rotary plate carriers 26, 28 are similarly cut away to allow access in the axial direction to the ends of the grooves 68 for the delivery and the recovery of balls to and from the spaces between the machining plates. The ends of the grooves 68 to which the balls are fed may be enlarged to facilitate the feed-in.

The wheel 20 is driven in rotation through a spur-gear 70 which engages the toothing 36 on the wheel radially outward periphery and is in turn engaged by a smaller spur gear 71 which is mounted on a shaft 72 driven by both the electric motors 38,40. The high reduction thus achieved gains the maximum mechanical advantage of the large circumference of the wheel 20. This arrangement is simple, and, as compared with the prior art arrangements, lessens the mechanical stresses applied by the drive to the support structure. The drive connection between the shaft 72 of the motors 38,40 and the gear 71 may be such as to permit the choice of different drive ratios for the wheel 20.

During the machining operation, the non-rotary plate carriers 26, 28 and the machining plates 30, 32 are at least mainly supported by the wheel 20 through the balls being machined. The carriers 26, 28 are prevented from rotation during the machining operation and supported at other times by stationary support means in the form of overhead channel-shaped tracks 74 and two laterally disposed circular-section dowels 76, all located outside the radially outward peripheries of the plate carriers 26, 28. The structural supports for the tracks 74 and dowels 76 are not shown. An axle carrying rollers 75 which run on the track 74 is journalled in a vertical beam 77 by which the non-rotary carriers 26,28 are suspended. The beam 77 has a swivel 78 to allow rotation of the carrier about a vertical axis (i.e. a horizontal plane).

The plate carriers 26, 28 each have two side brackets 80 in which slideblocks 81 sliding on the dowels 76 are mounted by means of vibration dampers 82 e.g. nylon pads. The blocks 81 can be slid off the ends of the dowels 76 when the carriers 26,28 are retracted sufficiently far from the wheel 20, and the carriers 26,28 can then be turned about the swivel 78 for inspection, replacement or servicing of a machining plate. When the plate carrier is turned about the swivel 78 in this manner, these operations on the machining plate are greatly facilitated as compared with the machine of FIG. 1. In particular, the rotary plate carrier (wheel 20) does not obstruct the removal of the plate from the non-rotary carrier. The members 74, 76 comprise stationary guide members located outside the periphery of the plates 30, 32 and in a position such that ground-off particles will generally not fall thereon, and extending in the axial direction away from the rotary plate carrier 20, and the rollers 75 and blocks 81 comprise means for mounting the non-rotary plate carriers 26, 28 so that they may be axially displaced along the guide members to permit access to the working plates 22, 24, 30, 32.

A casing 84 partially encloses each support 26, 28 during the machining operation. Conventional arrangements for lubrication of the working surfaces are provided, but not shown.

As mentioned above in this embodiment, the large diameter cylinder 42 and piston 44 are located centrally within the wheel 20. They can respectively be linked to the plate carrier 28 and the plate carrier 26 by axially extending rods 86 which are journalled in side plates 88 fixed in the side members 48 of the wheel 20. Passages lead through the rods 86 respectively from the two sides of the piston 44 in the cylinder 42 to their outer ends where nipples 89 allow self-sealing quick release connections to a hydraulic system. Adjacent their outer ends the rods 86 have circumferential grooves 90 into which half plates 92 are fitted before being bolted to the plate carriers 26, 28 to connect the complete force-applying connection. In operation as explained below the rods are placed in tension and abut on the plates 92 to transmit load to the plate carriers 26,28.

In use, the non-rotary carriers 26,28 carrying machining plates are pushed by hand along the track 74 and dowels 76 until they are sufficiently close to the machining plates on the wheel 20 to allow the half plates 92 to be fitted. At the same time a suitable ball feed mechanism of convnetional kind is brought into position in the gaps in the non-rotary plates. Hydraulic fluid is applied to the piston 44 to draw the non-rotary plate carrier 26, 28 towards each other, the wheel 20 is rotated and rough balls are fed into the grooves 67, 68 to begin the machining operation. When the pressure applied to the balls has caused the weight of the non-rotary carriers 26, 28 and their plates to be transferred onto the wheel 20, it will be seen that the forces acting on the plates are balanced within the assembly provided by the plate carriers 20,26,28 and the force-applying connection the reaction from the plates being led centrally through the rotating wheel 20. In theory, there should be no lateral forces on the wheel 20 which thus should require only vertical support, but in practice, due for instance to uneven plate wear, allowance has to be made for relatively small lateral forces.

The hydraulic cylinder 42 is suspended within the wheel 20. Consequently it can shift in order to accommodate differences in the thickness of the machining plates.

The piston and cylinder arrangement 42, 44 permits only limited movement of the rotary and non-rotary plate supports away from each other, but the force-applying connection constituted by the piston 44, the cylinder 42 and the two rods 86 is disconnectible at one or both ends from the plate carriers in order to permit movement apart of the plate carriers by a greater distance. During such movement apart and during for instance a plate changing operation, the non-rotary carriers are supported by the stationary support means (tracks 74 and/or dowels 76), this support means not forming part of the force-applying connection between the plate carriers, in contrast with the arrangement of FIG. 1. In operation, the force-applying connection is supported by the plate carriers.

Theoretically at least the machine shown in FIGS. 2 to 5 has double the output of the machine of FIG. 1. The vibration and noise level may also be reduced, because there are fewer independent structures capable of vibration. Standard ball feed arrangements may be used, and access to the feed gaps in the machining plates is greatly improved because of the absence of the pillar supports, which also makes plate changing easier.

The main frame of the machine is not required rigidly to hold the rotating wheel in position against the grinding forces but need only be such as to support the weight of the whole assembly. If it should be desired for any reason to use only one pair of plates the second pair may be replaced temporarily by plates forming an ordinary thrust bearing.

The machine shown in FIGS. 2 to 5 is clearly equally suitable for flashing, grinding and lapping operations and is suitable for use with plates now available.

It is envisaged that the centreless rotation of the wheel 20 shown in FIGS. 2 to 5 could be replaced by rotation on a bearing. Instead of a hydraulic ram to draw the non-rotating supports together, a pneumatic cylinder or a magnet could be used. Instead of the direct drive shown, pulley and belt drive or other suitable drive arrangements could be employed.

The diameter of the working plate of the machine of FIGS. 2 to 5 may be for example 42 ins. (105 cm). Nevertheless the machine may occupy a floor area less than that of any commercially available vertical plate machine having only one pair of plates.

The load carried by the bearings supporting the wheel 20 vertically may in operation be as high as 2 to 3 metric tons. Purely by way of example, the power input to the wheel may be 120 HP for a speed of rotation of the wheel of 100 rpm. With suitable motors and gearing, a speed range of 15 to 150 rpm. may be achieved.

The active area of the piston and cylinder assembly 42,44 may for example be about 30 sq. ins. (about 190 sq. cms.).

Figure 6:
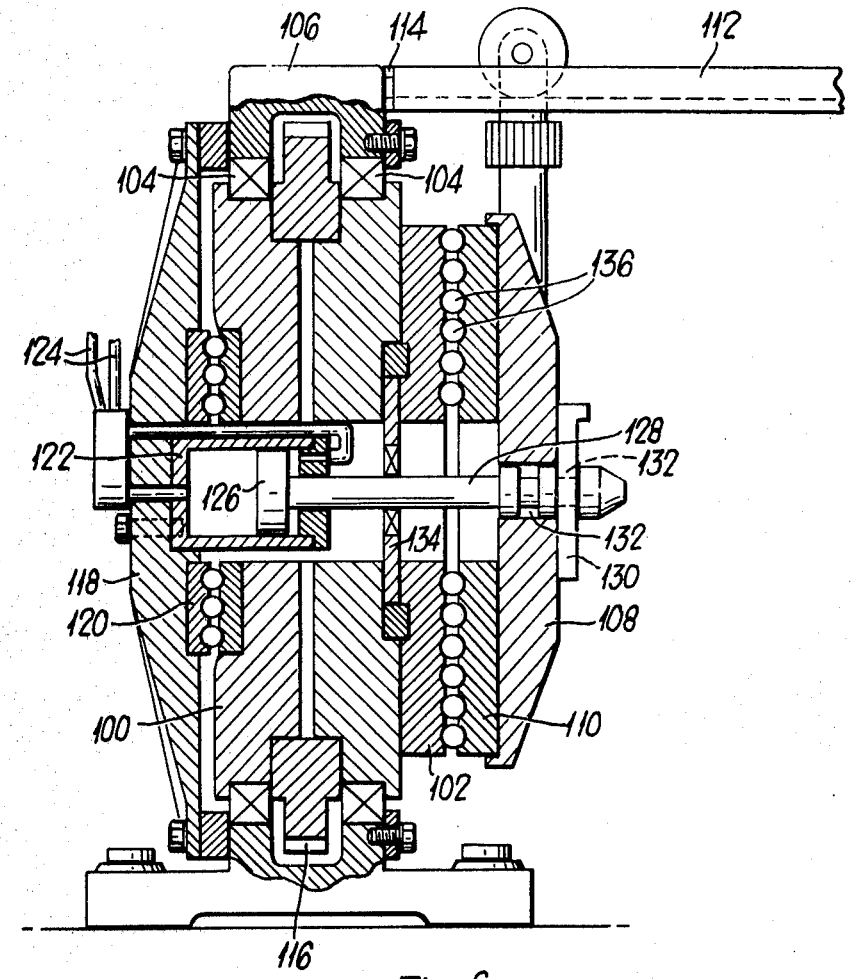
FIG. 6 is an axial sectional view of a second vertical plate machine embodying the present invention and having only one non-rotating plate.

An alternative embodiment of the invention is shown in FIG. 6. A rotatable wheel 100 carrying a ring plate 102 on one side only is mounted in anti-friction bearings 104 for rotation within a frame 106. A non-rotary plate carrier 108 carrying a gap plate 110 is suspended from a rail 112 in the same manner as the plate carriers 26, 28 described above. The rail 112 may be hingedly attached to the frame 106 at 114. The wheel 100 has a toothed periphery 116 and is driven in rotation in the same manner as the wheel 20 described above.

A stationary member 118 is mounted on the frame 106 on the other side of the wheel 100 and carries one race of a thrust bearing 120 which transmits lateral force from the wheel 100. The member 118 has a hydraulic cylinder 122 secured to it which is centrally located and is partly within the wheel 100. Feed lines 124 to the two ends of the cylinder 122 pass through the member 120. A piston 126 in the cylinder 122 is secured to a piston rod 128 which extends axially through the wheel 100, the plate 102 and (in operation) the plate 110 and the plate carrier 108 to beyond the carrier 108 to which it is releasably locked by a U-shaped plate 130 which is engageable in either of two circumferential grooves 132 in the rod 128. The rod 128 is maintained in its axial position by a bearing on a plate 134 secured to the wheel 100.

During a machining operation, balls 136 being ground to a spherical shape between the relatively rotating machining plates 102, 110 are fed in the axial direction through the non-rotating carrier 108 to the gap in the plate 110. Pressure is exerted on the plates by the fluid in the cylinder 122 acting on the piston 126, the force acting on the balls 136 being balanced through the connection formed by the rod 128 and the cylinder 122 which are disposed in the axis of the wheel 100. Lateral forces acting on the frame 106 are theoretically nil and in practice relatively small.

The provision of two grooves 132 in the rod 128 allows the position of the plate 130 to be varied to accommodate different thicknesses of the machining plates and also plate wear. This feature can also be applied in general for both the machines of the invention illustrated here.

The invention is not only applicable to machines for processing steel balls, but also for processing balls of other materials, for example bronze, aluminium, plastic, glass fibre etc., though all such balls may not under-go all the process steps mentioned at the beginning of this Specification.

While the invention has been illustrated above by reference to preferred embodiments, it will be understood by those skilled in the art that various changes may be made without departing from the spirit and scope of the invention and it is intended to cover all such changes and modifications by the appended claims.

What is claimed is:

1. A vertical plate machine for machining spherical objects between opposed generally vertical faces of at least one pair of opposed relatively rotatable working plates, having a. at least one non-rotary plate carrier adapted to carry a first working plate, b. a rotary plate carrier rotatable about an axis of rotation and having an end face adapted to carry a second working plate opposed to said first working plate, and having a radially outward periphery, located radially outwardly from said axis of rotation, c. means for driving said rotary plate carrier in rotation, said means including a rotatable driven member in engagement with said periphery of said rotary plate carrier to transmit drive to the rotary plate carrier, d. bearing means for providing vertical support for the rotary plate carrier, and cooperating with said periphery of said rotary plate carrier to support said rotary plate carrier for rotation about said axis of rotation, e. means for preventing access of ground-off particles to said bearing means and said rotatable driven member, said means including a stationary housing substantially enclosing said bearing means and said rotatable drive member and substantially sealed to said periphery, and f. pressure-applying means for causing said plates to apply pressure to objects being machined between the plates.

2. A vertical plate machine according to claim 1 having two of said non-rotary plate carriers arranged at opposite sides of said rotary plate carrier, the rotary plate carrier being adapted to carry two working plates respectively opposed to the working plates carried by said non-rotary carriers, said pressure-applying means including a extending centrally through the rotary plate carrier and acting to draw together the non-rotary plate carriers.

3. A vertical plate machine according to claim 1 wherein said pressure-applying means is supported by at least one of the plate carriers.

4. A vertical plate machine according to claim 1 having a base structure which supports the weight of an assembly comprised by the rotary and non-rotary plate carriers and the pressure applying means, the pressure applied to the objects being machined, and the reaction forces therefrom, being substantially confined to and equalized within said assembly.

5. A vertical plate machine according to claim 1 further comprising at least one stationary guide member supporting said non-rotary plate carrier and located outside the periphery of said first plate carried by said non-rotatable plate carrier, and extending in the axial direction away from said rotary plate carrier, and means mounting said non-rotary plate carrier so that it may be displaced along said guide member to permit access to said first and second plates.

6. A vertical plate machine according to claim 1 wherein said pressure-applying means comprises a connection including force-generating means and members arranged to transmit force generated by the force-generating means respectively to the non-rotary and the rotary plate carrier thereby to apply pressure to the objects being machined, said connection having at least a portion extending centrally through the working plates which portion is placed in tension by said force-generating means.

7. A vertical plate machine for machining spherical objects between opposed generally vertical faces of at least one pair of opposed relatively rotatable working plates, and comprising a. at least one non-rotary plate carrier carrying a first working plate, b. a rotary plate carrier carrying a second working plate opposed to said first working plate, c. means for rotating said rotary plate, d. pressure-applying means for urging said non-rotary and rotary plate carriers relatively towards each other so that working plates apply pressure to objects being machined, and e. means located outside the periphery of said first working plate for supporting said non-rotary plate carrier during operation and for maintaining said first working plate substantially parallel to said second working plate, said means comprising at least two stationary supports spaced apart around said periphery and having axial ends remote from said rotary plate, and means for mounting said non-rotary plate carrier on said supports so that it is axially displaceable along said axial ends of said supports so that non-rotary plate carrier may be removed from said supports to provide access to said plate; and a further stationary support for supporting the non-rotary plate carrier when it has moved beyond said ends.

8. A vertical plate machine for machining spherical objects between opposed generally vertical faces of two pairs of opposed relatively rotatable working plates, having a. two non-rotary plate carriers spaced apart from each other and respectively having faces adapted to carry plates opposed to each other, b. a wheel mounted between said non-rotary plate carriers and forming a rotary plate carrier, having opposite end faces adapted to carry plates respectively opposed to said plate-carrying faces of the respective non-rotary plate carriers, and having a radially outward periphery extending between said end faces, c. bearing means for providing vertical support for the wheel at least when in rotation, the bearing means cooperating with said periphery of the wheel to support said wheel for rotation, d. means for driving said wheel in rotation, including a driven member in engagement with said periphery to transmit rotational drive to the wheel, e. means for preventing access of ground-off particles from the grinding plates to said bearing means and said driven member, said means including a housing substantially enclosing said bearing means and said driven member and substantially sealed to said periphery of said wheel, and f. force-applying means arranged to draw said non-rotary plate carriers towards each other thereby to cause the respective pairs of working plates to apply pressure to objects being machined.

9. A vertical plate machine according to claim 8 wherein said driven member is a toothed member and said wheel has peripheral toothing in engagement with said toothed member.

10. A vertical plate machine according to claim 8 wherein at least in operation of the machine, said force-applying means is supported by the plate carriers.

11. A vertical plate machine according to claim 10 wherein said force applying means comprises a connection extending centrally through the wheel.

12. A vertical plate machine according to claim 8 having support means for supporting said non-rotary plate carriers at least when the machine is not in use in a machining operation, said force-applying means being disconnectible from at least one of the non-rotary plate carriers so as to permit movement of both the non-rotary plate carriers away from the wheel while supported by the said support means to allow access to the working plates.

13. A vertical plate machine for machining spherical objects between opposed generally vertical faces of two pairs of opposed relatively rotatable working plates, having a. two non-rotary plate carriers spaced apart from each other and respectively having faces adapted to carry plates opposed to each other, b. a wheel mounted between said non-rotary plate carriers and forming a rotary plate carrier, having opposite end faces adapted to carry plates respectively opposed to said plate-carrying faces of the respective non-rotary plate carriers, and having a periphery, and comprising a plurality of rolling members which are rotatable about respective stationary axes spaced from the axis of rotation of the wheel, and engage said periphery of the wheel, said rolling members being mounted on at least two bogie members pivotable about axes parallel to and spaced from the axes of rotation of the rolling members, c. bearing means for providing vertical support for the wheel at least when in rotation, the bearing means cooperating with said periphery of the wheel, d. means for driving said wheel in rotation, and e. force-applying means arranged to draw said non-rotary plate carriers towards each other thereby to cause the respective pairs of working plates to apply pressure to objects being machined.

14. A vertical plate machine according to claim 13 having guide means for supporting the wheel against axial movement, said guide means comprising axially adjustable rotatable members engaging an axially facing surface at the periphery of the wheel.

15. A vertical plate machine for machining spherical objects between opposed generally vertical faces of at least one pair of opposed relatively rotatable working plates, having a. at least one non-rotary plate carrier adapted to carry a first working plate, b. a rotary plate carrier adapted to carry a second working plate opposed to said first working plate, c. means for driving said rotary plate in rotation, d. pressure-applying means interconnecting the non-rotary and rotary plate carriers and adapted to urge them relatively towards each other so as to cause the working plates to apply pressure to objects being machined, the pressure-applying means being disconnectible in a manner so that in consequence of the disconnection there is permitted movement of the non-rotary plate carrier away from the rotary plate carrier for access to the working plates, and e. stationary support means for said non-rotary plate carrier operative at least when said pressure-applying means is disconnected and during said movement of the non-rotary plate carrier away from the rotary plate carrier whereby support is provided for the non-rotary plate carrier while access is had to the working plates, said non-rotary plate carrier being supported by said support means so as to be turnable in a horizontal plane in order to bring the non-rotary plate out of parallel opposition to the rotary plate, whereby obstruction by the rotary plate of removal of the non-rotary plate from the non-rotary plate carrier is reduced.

16. A vertical plate machine for machining spherical objects between opposed generally vertical faces of at least one pair of opposed relatively rotatable working plates, having a. at least one non-rotary plate carrier adapted to carry a first working plate, b. a rotary plate carrier adapted to carry a second working plate opposed to said first working plate, c. means for driving said rotary plate in rotation, d. pressure-applying means interconnecting the non-rotary and rotary plate carriers and adapted to urge them relatively towards each other so as to cause the working plates to apply pressure to objects being machined, the pressure-applying means being disconnectible in a manner so that in consequence of the disconnection there is permitted movement of the non-rotary plate carrier away from the rotary plate carrier for access to the working plates, and e. stationary support means for said non-rotary plate carrier operative at least when said pressure-applying means is disconnected and during said movement of the non-rotary plate carrier away from the rotary plate carrier whereby support is provided for the non-rotary plate carrier while access is had to the working plates, said support means permitting the pivoting of the non-rotary plate carrier about a vertical axis.

17. A vertical plate machine for machining spherical objects between opposed generally vertical faces of at least one pair of opposed relatively rotatable working plates, and comprising a. at least one non-rotary plate carrier carrying a first working plate, b. a rotary plate carrier carrying a second working plate opposed to said first working plate, c. means for rotating said rotary plate carrier, d. pressure-applying means for urging said non-rotary and rotary plate carriers relatively twoards each other so that said working plates apply pressure to objects being machined, and e. means located outside the radially outward periphery of said first working plate for supporting said non-rotary plate carrier during operation and for maintaining said first working plate substantially parallel to said second working plate, said means comprising at least two stationary supports spaced apart around said radially outward periphery and having axial ends remote from said rotary plate, and means for mounting said non-rotary plate carrier with respect to said supports so that said non-rotary plate carrier is axially displaceable along said supports towards and away from said rotary plate, said mounting means including an overhead carrier for carrying said non-rotary plate carrier beyond said axial ends of said supports so that said non-rotary plate carrier may be removed from said supports to provide access to said plate; and portions of said mounting means being secured to said non-rotary plate carrier so that said supports resist the forces transmitted through the plates which tend to cause rotation of said non-rotary plate carrier, when the supports are engaged by said mounting means portions.

18. A vertical plate machine according to claim 17 wherein said supports extend substantially alongside the region at which grinding occurs.

19. A vertical plate machine according to claim 17 wherein said non-rotary plate carrier is slidable along said supports.

20. A vertical plate machine according to claim 17 wherein said supports are located at positions around the periphery of the said first working plate such that ground-off particles will generally not fall upon them.

21. A vertical plate machine according to claim 17 wherein said pressure applying means extends centrally through the working plates.

22. A vertical plate machine for machining spherical objects between opposed generally vertical faces of two pairs of opposed relatively rotatable working plates, having a. two non-rotary plate carriers spaced apart from each other and respectively having faces adapted to carry plates opposed to each other, b. a wheel mounted between said non-rotary plate carriers and forming a rotary plate carrier, having opposite end faces adapted to carry plates respectively opposed to said plate-carrying faces of the respective non-rotary plate carriers, and having a radially outward periphery extending between said end faces, c. bearing means for providing vertical support for the wheel at least when in rotation, the bearing means cooperating with said periphery of the wheel to support said wheel for rotation, d. means for driving said wheel in rotation, e. at least two stationary supports for each non-rotary plate carrier located outside the radially outward periphery of said plate carrier by the respective non-rotary plate carrier, and spaced apart around the radially outward periphery of said plate carrier, and means mounting each non-rotary plate carrier on its respective supports so that it is axially displaceable towards and away from said rotary plate, said mounting means being secured to said non-rotary plate carrier so that said supports resist the forces transmitted through the plates which tend to cause rotation of said non-rotary plate carrier, and f. force-applying means arranged to draw said non-rotary plate carriers towards each other thereby to cause the respective pairs of working plates to apply pressure to objects being machined.

23. A vertical plate machine for machining spherical objects between opposed generally vertical faces of two pairs of opposed relatively rotatable working plates, having a. two non-rotary plate carriers spaced apart from each other and respectively having faces adapted to carry plates opposed to each other, b. a wheel mounted between said non-rotary plate carriers and forming a rotary plate carrier, having opposite end faces adapted to carry plates respectively opposed to said plate-carrying faces of the respective non-rotary plate carriers, and having a periphery extending between said end faces, said wheel periphery having a diameter at least as great as that of the plates, c. bearing means for providing vertical support for the wheel at least when in rotation, the bearing means cooperating with said periphery of the wheel, d. means for driving said wheel in rotation, including a driven member in engagement with said periphery to transmit drive to the wheel, e. means for preventing access of ground-off particles from the grinding plates to said bearing means and said driven member, said means including a housing substantially enclosing said bearing means and said driven member and substantially sealed to said periphery of said wheel, and f. force-applying means arranged to draw said non-rotary plate carriers towards each other thereby to cause the respective pairs of working plates to apply pressure to objects being machined.

24. A vertical plate machine for machining spherical objects between opposed generally vertical faces of two pairs of opposed relatively rotatable working plates, having a. two non-rotary plate carriers spaced apart from each other and respectively having faces adapted to carry plates opposed to each other, b. a wheel mounted between said non-rotary plate carriers and forming a rotary plate carrier, having opposite end faces adapted to carry plates respectively opposed to said plate-carrying faces of the respective non-rotary plate carriers, and having a periphery extending between said end faces, c. bearing means for providing vertical support for the wheel at least when in rotation, the bearing means cooperating with said periphery of the wheel, said bearing means comprising a plurality of rolling members which are rotatable about respective stationary axes spaced from the axis of rotation of the wheel, and engaging said wheel periphery, d. means for driving said wheel in rotation, including a driven member in engagement with said periphery to transmit drive to the wheel, e. means for preventing access of ground-off particles from the grinding plates to said bearing means and said driven member, said means including a housing substantially enclosing said bearing means and said driven member and substantially sealed to said periphery of said wheel, and f. force-applying means arranged to draw said non-rotary plate carriers towards each other thereby to cause the respective pairs of working plates to apply pressure to objects being machined.

* * * * *